US006434866B1

(12) United States Patent
Kawamoto et al.

(10) Patent No.: US 6,434,866 B1
(45) Date of Patent: Aug. 20, 2002

(54) DEVICE FOR ATTACHING AND DETACHING A COUNTERWEIGHT OF CONSTRUCTION MACHINE

(75) Inventors: Kenji Kawamoto; Satoshi Mizukawa; Shouzou Fujiwara; Aturo Akiyama, all of Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 09/991,645

(22) Filed: Nov. 26, 2001

(30) Foreign Application Priority Data

Nov. 30, 2000 (JP) ..... 2000-364606

(51) Int. Cl.[7] ..... E02F 9/18
(52) U.S. Cl. ..... 37/466
(58) Field of Search ..... 37/466, 394, 395, 37/396, 397, 401, 403

(56) References Cited

FOREIGN PATENT DOCUMENTS

| | | |
|---|---|---|
| JP | 3-18089 | 2/1991 |
| JP | 7-324354 | 12/1995 |
| JP | 8-302746 | 11/1996 |
| JP | 8-319637 | 12/1996 |
| JP | 9-78629 | 3/1997 |
| JP | 10-219746 | 8/1998 |
| JP | 11-1940 | 1/1999 |

*Primary Examiner*—Christopher J. Novosad
(74) *Attorney, Agent, or Firm*—Oblon, Spivak, McClelland, Maier & Neustadt, P.C.

(57) ABSTRACT

A construction machine having a device for attaching and detaching a counterweight according to the present invention comprises a lower traveling body; an upper rotating body mounted rotatably on the lower traveling body; the upper rotating body having a support bed standing out from a rear part thereof; and a device for attaching and detaching a counterweight mounted on the support bed. The attaching and detaching device comprises a telescoping device having a lower end pivotally connected in the vicinity of the support bed, a restiform body suspended through a guide portion provided on the telescoping device; and oscillating structure for oscillating the telescoping device around the lower end as fulcrum. The oscillating structure displaces the telescoping device extended from a substantially vertical attitude to an inclined attitude when the counterweight is detached. According to the present invention, an inclined bed is not required, and locating of the counterweight to the support bed can be done easily.

9 Claims, 6 Drawing Sheets

DEVICE FOR ATTACHING AND DETACHING A COUNTERWEIGHT OF CONSTRUCTION MACHINE

BACKGROUND OF THE INVENTION

1. Field of the Invention

The present invention relates to a device for attaching and detaching a counterweight of a construction machine.

2. Description of the Related Art

A counterweight (hereinafter sometimes referred to as CW) of a construction machine is normally placed on a support bed projected horizontally from a rear end of a rotating frame of an upper rotating body. The CW is secured to the support bed by means of fixing bolts. The CW is removed when the construction machine is transported, and mounted when working. When the CW is attached or detached, the CW has to be lifted or suspended so as not to interfere with the support bed.

For example, a method for attaching and detaching a counterweight disclosed in Japanese Patent Application Laid-Open No. Hei 7-324354 is known. As shown in FIG. 8*a*, first, a construction machine 80 is gone up to an inclined bed 81 to incline an upper rotating body 88. Then, an upper portion 84*a* of a boom 84 and an upper surface portion 85*a* of CW 85 are connected by a wire rope 87 through a sheave 86*a* provided on an upper end of a mast 86, and the fixing bolts are removed. As a result, the CW 85 is hung down from the sheave 86*a* by gravity, and the CW 85 is moved away from the support bed 89.

Next, as shown in FIG. 8*b*, when the boom 84 is raised up, the wire rope 87 is delivered from the sheave 86*a* whereby the CW 85 can be dropped off on the ground.

However, in the aforementioned method, a large inclined bed has to be prepared every time the CW 85 is attached or detached. Moreover, there poses a problem that the construction machine is forced to assume the unstable attitude.

Further, since rewinding or hoisting of a wire rope is carried out by boom rasing or lowering operation, it is difficult to locate the CW 85 to the support bed. Moreover, an operator who operates the boom is not able to grasp the suspending condition of the CW 85 from an operating seat. There is a problem that since operation has to be carried out through the aid of a person giving a sign, the work efficiency is poor.

SUMMARY OF THE INVENTION

It is an object of the present invention to provide a device for attaching and detaching a counterweight capable of attaching and detaching a counterweight easily and simply to attain the enhancement of the efficiency of attaching and detaching work, and a construction machine having the device.

The construction machine having a device for attaching and detaching a counterweight according to the present invention has the following constitution.

The present invention comprises a lower traveling body; an upper rotating body mounted rotatably on the lower traveling body, the upper rotating body having a support bed standing out from a rear portion thereof; an attaching and detaching device for attaching and detaching a counterweight mounted on the support bed. The attaching and detaching device comprises a telescoping device having a lower end pivotally connected in the vicinity of the support bed, a restiform body hung down through a guide portion provided on the telescoping device, and oscillating means for oscillating the telescoping device around the lower end as fulcrum. The oscillating means displaces the telescoping device extended from a substantially vertical attitude to an inclined attitude when the counterweight is removed or moved downward.

In this case, when the telescoping device is expanded or contracted, the counterweight can be raised or fallen through the restiform body hung down from the guide portion. When the telescoping device is displaced from a substantially vertical attitude to an inclined attitude by the oscillating means, the counterweight can be moved to a position not to interfere with the support bed or the counterweight can be moved upward of the support bed without interfering with the support bed. Because of this, the counterweight can be attached or detached from the support bed by its own exertions and quickly.

Further, since a series of operation are carried out while lifting the counterweight (that is, while maintaining a fixed attitude), it is also easy to locate of the counterweight to the support bed.

DESCRIPTION OF THE PREFERRED EMBODIMENTS

Figure 1:
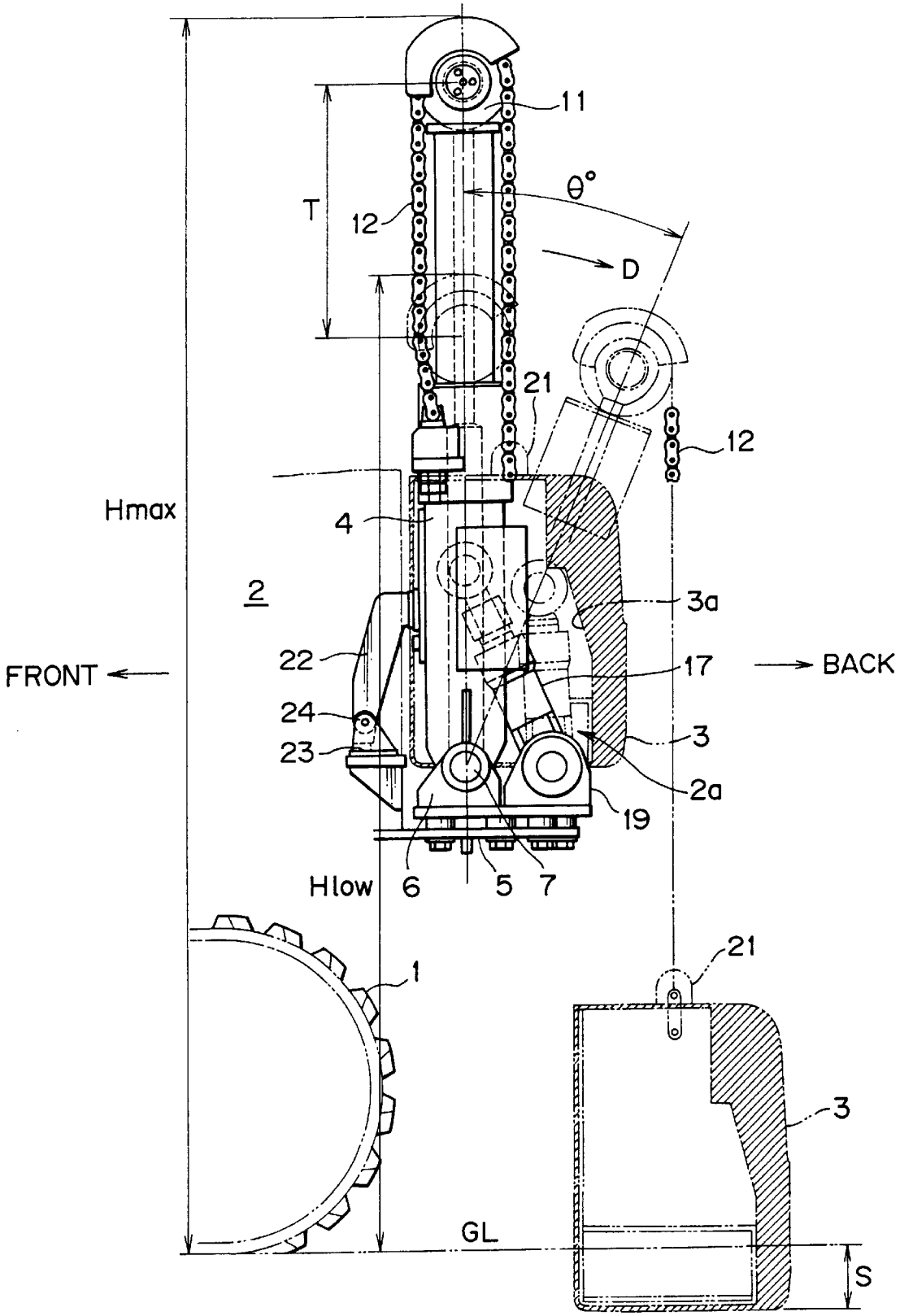
FIG. 1 is a front view showing the constitution of a device for attaching and detaching a counterweight according to one embodiment of the present invention.

The present invention will be described hereinafter on the basis of embodiments shown in the drawings. This is one embodiment of the present invention and is not limited thereto.

FIG. 1 shows one embodiment of a device for attaching and detaching a counterweight according to the present invention. In the construction machine shown in the figure, an upper rotating body 2 is mounted rotatably on a lower traveling body having a crawler 1 mounted thereon. A support bed 2*a* for placing a CW 3 thereon is stood out in a horizontal direction from a rear end of the upper rotating body 2.

The CW 3 placed on the support bed 2*a* is formed, in its central portion, with a depressed groove 3*a* from a planar view thereof. Telescoping arms 4 as a pair of telescoping devices are stood upright within the depressed groove 3*a* (only a telescoping arm 4 near side is shown).

Figure 2B:
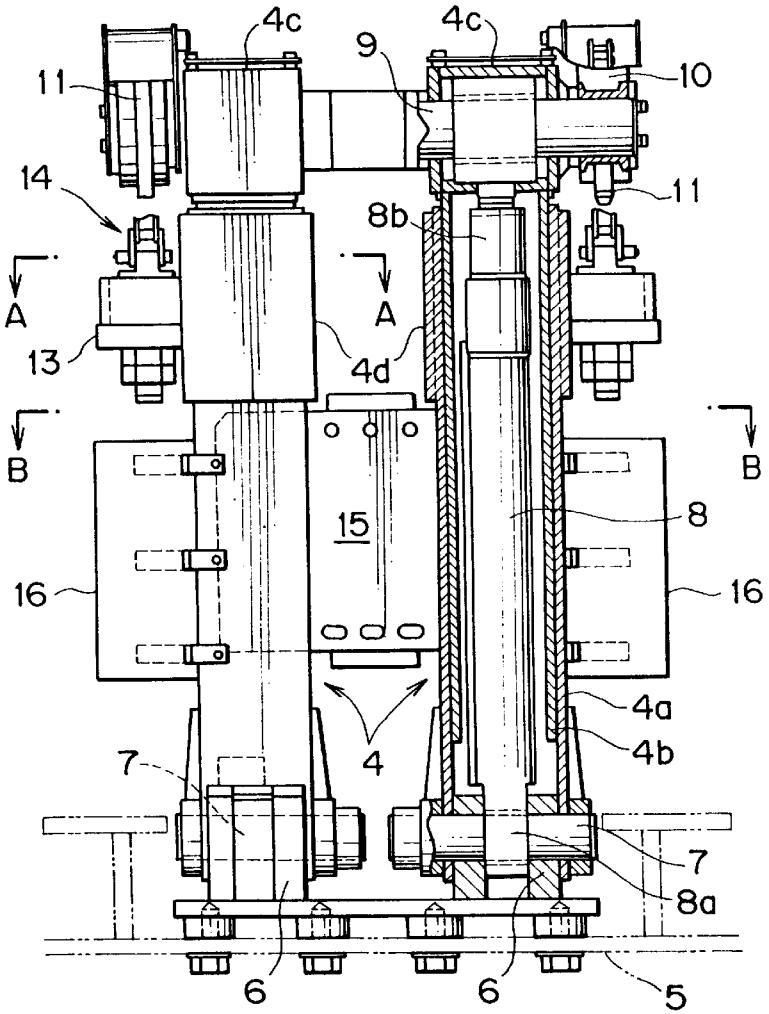
FIG. 2*b* is a right side view thereof.
Figure 2A:
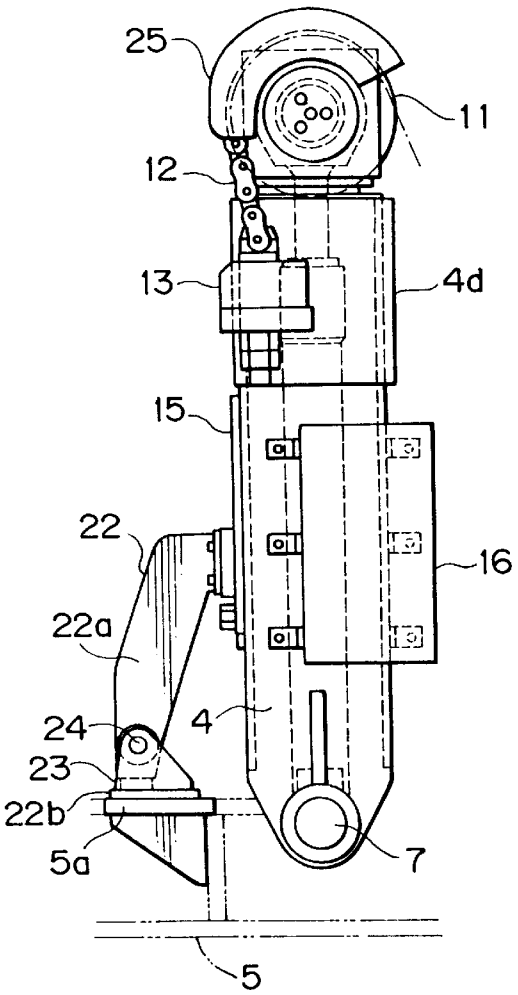
FIG. 2*a* is a front view showing, in an enlarged scale, the constitution of an expansion and contraction arm as telescoping devices according to the device of FIG. 1.

FIGS. 2*a* and 2*b* show the constitution of the telescoping arm 4 in an enlarged scale. Particularly, FIG. 2*a* is a front view thereof, and FIG. 2*b* is a right side view thereof. The telescoping arm 4 has an outer tube 4*a* and an inner tube 4*b* which slidably moves within the outer tube 4*a*. The lower end of the outer tube 4*a* is connected through a connecting pin 7 to a bearing 6 stood upright in parallel from a floor plate 5.

On the other hand, a box 4*c* is secured to the upper end within the inner tube 4*b*. A rotational shaft 9 is inserted so as to extend through the box 4*c* in a horizontal direction. Sprockets 11 as a guide unit are rotatably mounted on opposite ends of the rotational shaft 9 through a bearing unit 10. A hydraulic cylinder 8 is inserted into the inner tube 4*b*. A tube lower end 8*a* of the hydraulic cylinder 8 is connected to the connecting pin 7. An end 8*b* of a rod is connected to the rotational shaft 9. Accordingly, when a pair of hydraulic cylinders 8 provided internally of the telescoping arms 4 are expanded and contracted in cooperation each other, the rotational shaft 9 held on both the boxes 4*c* moves up and down. Thereby, the sprockets 11 can be moved up and down.

A reinforcing ring 4*d* is wound around the upper end of the outer tube 4*a*. One end of the chain 12 as a restiform body is secured to the reinforcing ring 4*d*. In detail, a mounting fitting 13 is secured to the side wall of the reinforcing ring 4*d*. One end of the chain 12 is secured to a coupling 14 provided on the mounting fitting 13.

The chain 12 is hung down turning down the sprockets 11, and the other end thereof is connected to the upper part of the CW 3. It is noted that the overall length of the chain 12 is set to a length enough to move down the CW 3 removed from the support bed 2*a* on the ground.

In the present embodiment, the restiform body is constituted by a chain, the guide unit is engaged with the chain, and is constituted by a rotatable sprocket. Therefore, it is possible to suppress vibrations in the width direction of a body of the machine when a counterweight is attached or detached.

Figure 3:
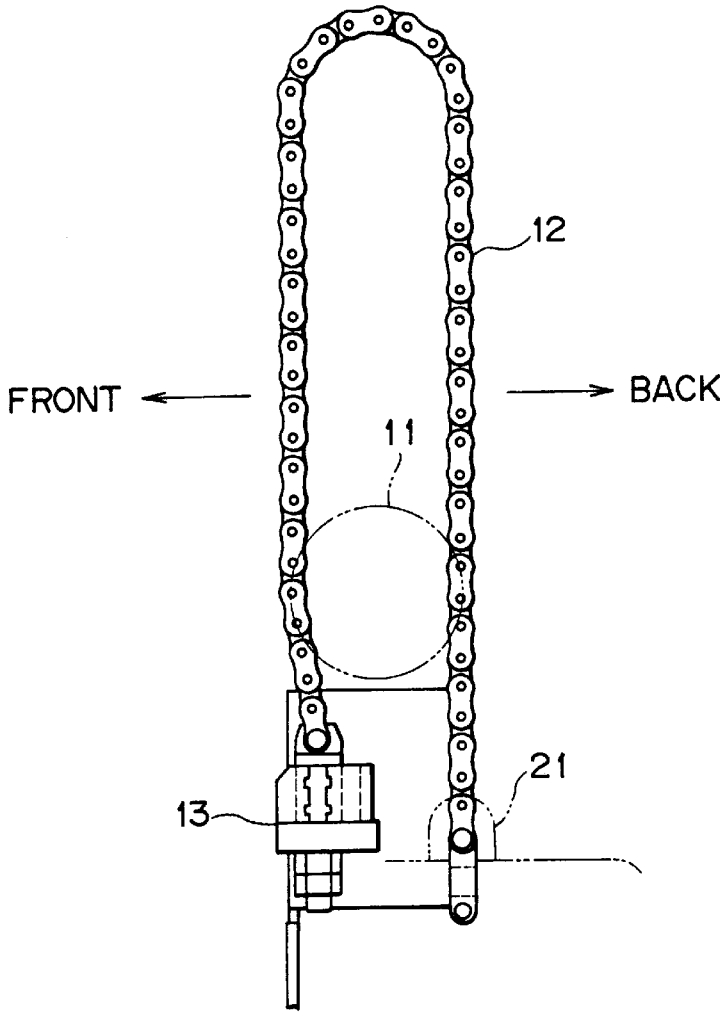
FIG. 3 is an enlarged view of a chain fixing portion shown in FIG. 1.

Further, as shown in an enlarged view of FIG. 3, the mounting fitting 13 is connected to one end of the chain 12 while being displaced somewhat rearward. Thereby, the amount of engagement of the chain 12 with respect to the sprockets 11 is increased. As a result, even if the telescoping arm 4 is contracted in the state that the CW 3 is removed and the chain 12 loses tension, the amount of engagement is kept increased. Accordingly, the chain 12 is hard to be disengaged from the sprockets 11.

Figure 4:
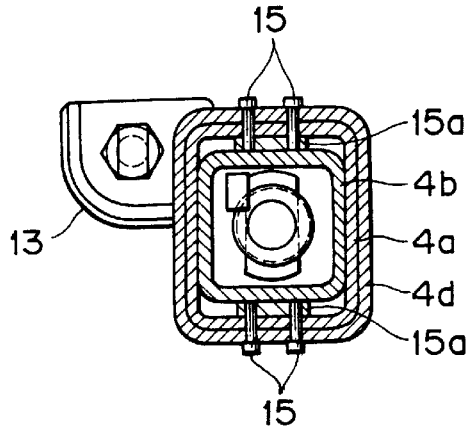
FIG. 4 is a sectional view taken on A—A of FIG. 2*b;*

FIG. 4 is a cross-section view taken on A—A of FIG. 2*b*. An inner tube 4*b* having a square in section is housed in an outer tube 4*a* having a rectangular shape in section. The inner tube 4*b* is supported by a pair of sliders 15*a* secured to the outer tube 4*a* by a bolt 15. The inner tube 4*b* slides smoothly with the sliders 15*a* as a guide unit.

Figure 5:
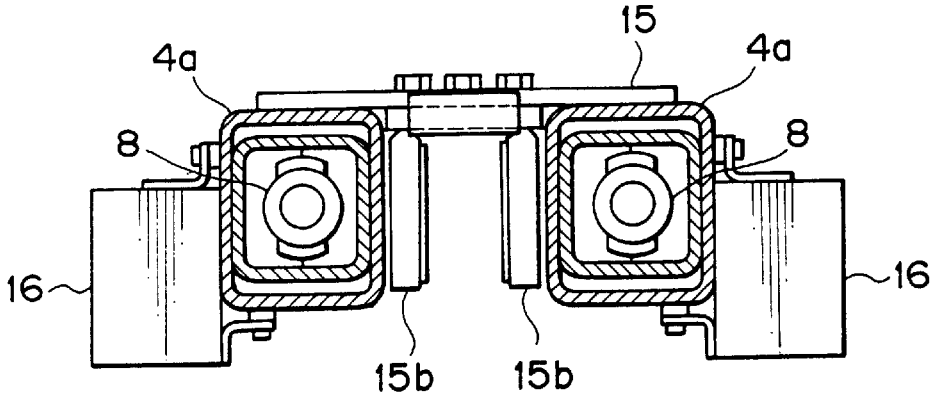
FIG. 5 is a sectional view taken on B—B of FIG. 2*b;*

FIG. 5 is a cross-section view taken on B—B of FIG. 2*b*. Side walls on the machine side of both the outer tubes 4*a* are connected by a connecting plate 15. A pair of brackets 15*b* projected in parallel from the connecting plate 15 are arranged between both the outer tubes 4*a*. Numeral 16 denotes a housing box mounted on the lateral side wall of the outer tube 4*a* to house the chain 12 removed from the CW 3.

Figure 6:
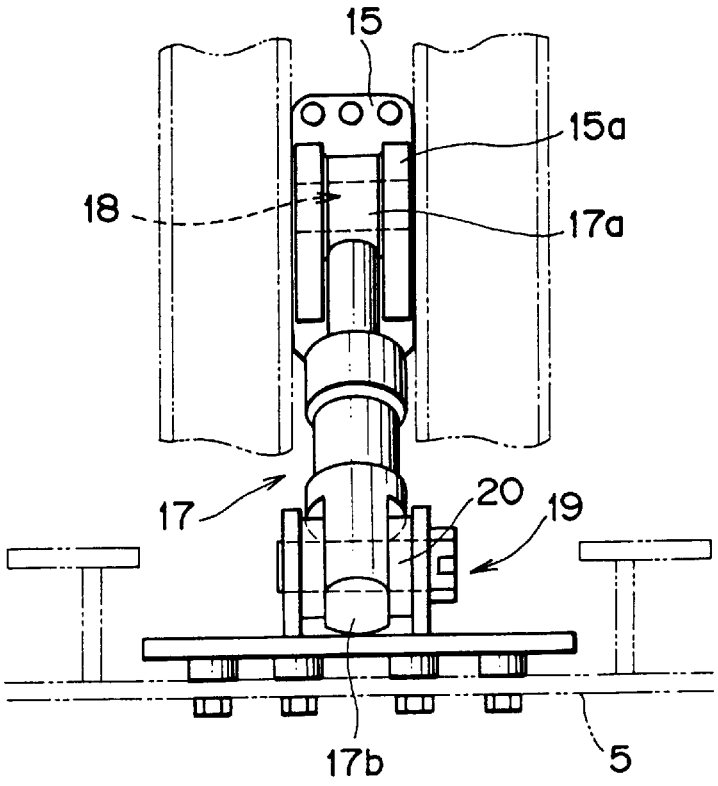
FIG. 6 is a schematic view showing a mounting state of a hydraulic cylinder 17 shown in FIG. 1.

To the brackets 15*b* is connected an end 17*a* on the rod side of a hydraulic cylinder 17 as oscillating means shown in FIG. 6 through a first pin 18. A tube lower end 17*b* of the hydraulic cylinder 17 is connected to a bearing 19 provided on a floor plate 5 through a second pin 20. Accordingly, when the hydraulic cylinder 17 is contracted, the telescoping arm 4 can be displaced from a substantially vertical position (a position indicated by the solid line of FIG. 1) to an inclined position inclined by θ° (a position indicated by the chain double-dashed lines in FIG. 1).

The angle θ is set to an angle such that when the CW 3 somewhat lifted up is moved down, the CW 3 is not substantially interfere with the support bed 2*a* standing out from the upper rotating body 2.

In the present embodiment, the oscillating means is constituted by a hydraulic cylinder. The lower end thereof is arranged in the vicinity of a pivotal portion of the telescoping arm. If the rod of the hydraulic cylinder is connected to the outer tube of the telescoping arm, the telescoping arm can be oscillated with a hydraulic pump as a drive source provided on the construction machine without using a special drive mechanism.

Figure 7A:
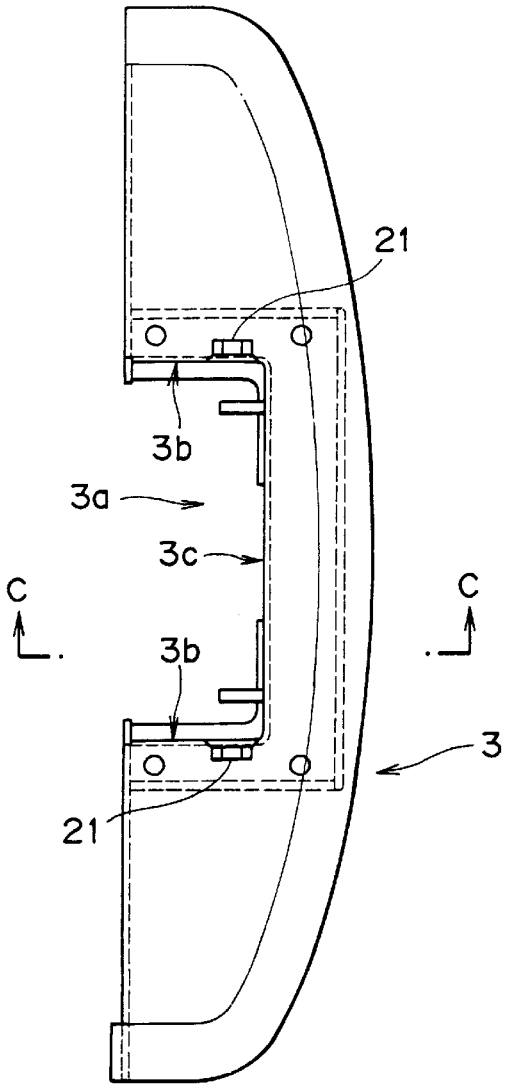
FIG. 7*a* is a plan view showing the constitution of a counterweight 3 shown in FIG. 1.
Figure 7B:
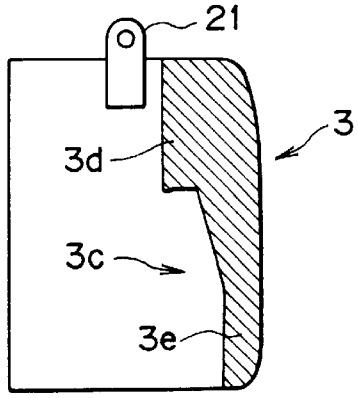
FIG. 7*b* is a sectional view taken on C—C thereof.
Figure 8A:
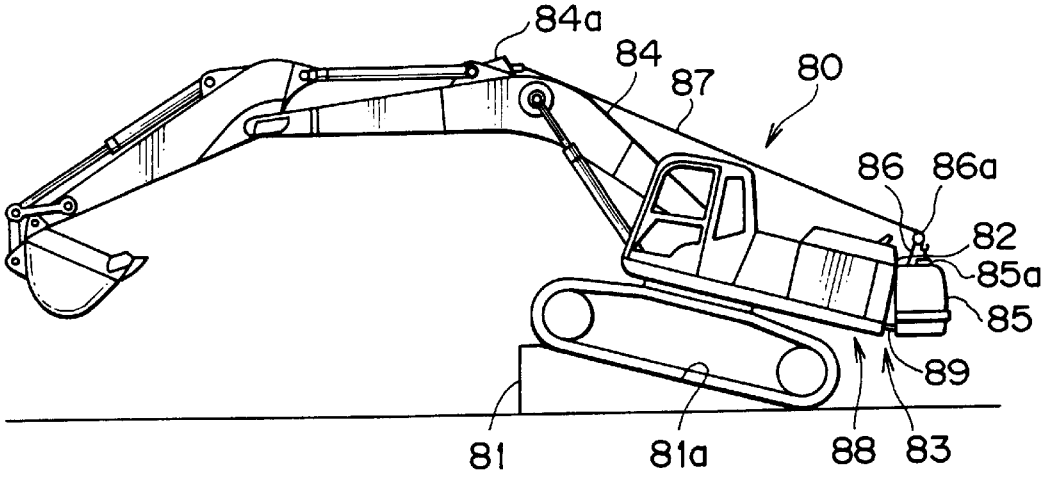
FIG. 8a PRIOR ART
FIGS. 8*a* and 8*b* are respectively schematic views showing a conventional method for attaching and detaching a counterweight.
Figure 8B:
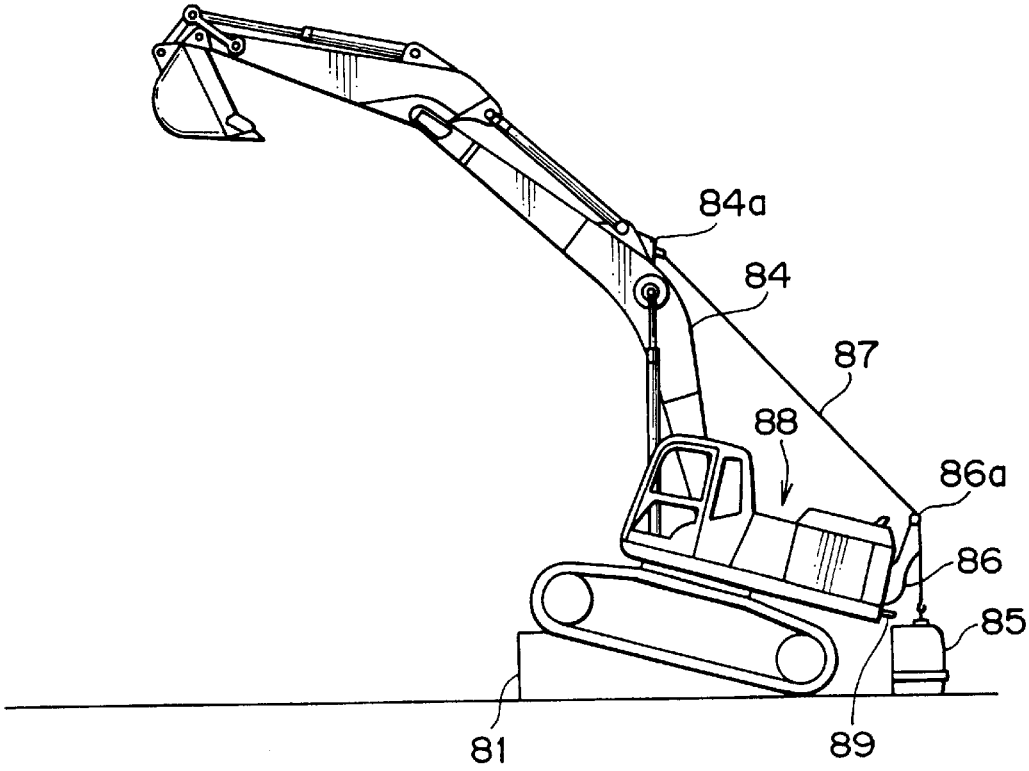
FIG. 8b PRIOR ART

Further, FIGS. 7*a* and 7*b* show the constitution of CW. Particularly, FIG. 7*a* is a plan view thereof, and 7*b* is a sectional view taken on C—C thereof.

The CW 3 is formed in its central portion with a depressed groove 3*a* in the shape of horseshoe as shown in FIG. 7*a*. Suspension fittings 21 for connecting the other end of the chain 12 are respectively secured by way of welding to opposed side walls 3*b*, 3*b* opposed in the depressed groove 3*a*. The rear side wall 3*c* perpendicular to the side walls 3*b*, 3*b* is formed at the upper part with a thick portion 3*d* as shown in FIG. 7*b*. At the lower part is formed a thin portion 3*e* in order to avoid interference with the hydraulic cylinder 17 for oscillation.

Further, in FIG. 2*a*, numeral 22 denotes a fixing plate for fixing the telescoping arm 4 when the construction machine is transported. This fixing plate 22 is projected forward-downwardly from the front surface (on the machine side) of the connecting plate 15. A stop plate 22*b* capable of coming into contact with a receiving plate 5*a* of the floor plate 5 is provided at one end 22*a* of the fixing plate 22. When the receiving plate 5*a* and the stop plate 22*b* come in contact with each other, the telescoping arm 4 is stood upright substantially vertically.

A slot such as a long hole is formed in the end 22*a* of the fixing plate 22. On the other hand, the receiving plate 5*a* of the floor plate 5 is formed with a pair of brackets 23 corresponding to the end 22*a* of the fixing plate 22. A fixing pin 24 is inserted into through-holes of the pair of brackets 23 and the slot whereby the erected telescoping arm 4 can be secured.

In the figure, numeral 25 denotes a chain cover for preventing the chain 12 from dropping out of each of the sprockets 11.

For the purpose of switching the direction of pressure oil with respect to the hydraulic cylinder 8 and the hydraulic cylinder 17, a manual switching valve for operating a valve spool by a manual lever (an operating body) may be provided. Preferably, the manual switching valve is provided at a portion where it is capable of confirming a hoisting movement of the CW 3 and is located on an external body of the construction machine. This allows an operator to carry out the attaching and detaching operation of the CW 3 single-handedly.

Further, the manual switching valve may be constituted by an electromagnetic valve, and the operation of the valve spool may be remote-controlled. This allows an operator to carry out the attaching and detaching operation of the CW 3 at a position away from the construction machine.

Now, the attaching and detaching operation by way of the device for attaching and detaching a counterweight having the above-described constitution will be explained.

In FIG. 1, when the counterweight 3 is not attached or detached, the telescoping arm 4 is in the contracted state. In this case, the maximum height is shown by H low.

A description will be made hereinafter of a case where the CW 3 is removed from the support bed 2*a*.

First, the fixing pin 24 for connecting the fixing plate 22 and the brackets 23 is pulled out. Bolts for connecting a bottom portion of the CW 3 and the support bed 2*a* is removed. The bolts comprise generally four bolts which are inserted from the bottom of the support bed 2*a* and fastened and secured to the bottom portion of the CW 3.

Next, the hydraulic cylinder 8 (see FIGS. 2*a*, 2*b*) is extended by a fixed amount to draw the chain 12 out of the chain housing box 16. The other end thereof is connected to the suspension fitting 21 of the CW 3.

Next, the hydraulic cylinder 8 is stretched to the maximum stroke T. The chain 12 on the side connected to the CW 3 is raised through the sprockets 11. Thereby, the CW 3 is levitated or come up somewhat from the support bed 2*a*.

Next, the hydraulic cylinder 17 is contracted whereby the telescoping arm 4 is rotated in a direction of arrow D around the connecting pin 7 as fulcrum. When the telescoping arm is inclined by θ°, the contracting operation is stopped. At this time, the CW 3 is located to position rearward and upward of the machine body, displaced from a position where the CW is mounted on the supported bed 2*a*.

Next, the stretched hydraulic cylinder 8 is operated to be contracted whereby the other end of the chain 12 is rewound through the sprockets 11. Thereby the CW 3 is moved down on the ground (ground level (GL) of FIG. 1).

It is noted that there is room S for a suspension allowance of CW 3 so that the attaching and detaching of the chain 12 can be carried out easily with respect to the suspension fitting 21.

Next, the other end of the chain 12 is removed from the suspension fitting 21, and the procedure reversed to that mentioned above is carried out. That is, the hydraulic cylinder 17 is stretched out, the telescoping arm 4 is returned to a substantially vertical attitude, and the hydraulic cylinder 8 is contracted. Thereby, the telescoping arm 4 is returned to an initial position. However, the other end of the chain 12 is to be housed into the chain housing box 16.

Next, the fixing pin 24 is inserted into the fixing plate 22 and the brackets 23. Thereby, the telescoping arm 4 is secured to assume a state capable of being transported.

Further, in a case where the CW 3 is mounted on the support bed 2*a*, the following procedure is taken. First, the hydraulic cylinder 8 is stretched out, and the other end of the chain 12 is drawn out of the chain housing box 16. The hydraulic cylinder 17 is contracted to incline the telescoping arm 4 by θ°. The hydraulic cylinder 8 is contracted and the other end of the chain 13 is moved down onto the suspension fitting 21 of the CW 3.

Next, the other end of the chain 12 is connected to the suspension fitting 12, and the hydraulic cylinder 8 is stretched out to thereby force up the CW 3. At this time, since the telescoping arm 4 is in the inclined attitude, the CW 3 is not interfere with the support bed 2*a* at the time of lifting. Next, the hydraulic cylinder 17 is stretched out to erect the telescoping arm 4 substantially vertically. Further, the hydraulic cylinder 8 is contracted to move down the CW 3 on the support bed 2*a*.

As described above, the CW 3 can be moved in a constant attitude or upright posture till it moves from the ground to the support bed 2*a*. Because of this, the counterweight can be mounted extremely easily. Moreover, the CW 3 is moved up and down using the chain 12, and movement in the width direction of the chain 12 is suppressed by engagement of the chain 12 with the sprockets 11. Accordingly, it is possible to suppress swinging of the CW in the width direction of the machine. If the CW 3 is placed on the support bed 2*a* without swinging as described above, positioning can be also carried out accurately, quickly and simply.

Next, when the bolts are inserted from the bottom of the support bed 2*a*, and fastened and secured to the bottom of the CW 3, a mounting of the CW 3 is completed.

Since the restiform body according to the present invention is able to suppress swinging in the width direction of the machine body, use of a chain is preferable. Of course, a wire rope can be also used depending on the weight of a counterweight.

Further, the oscillating means is constituted by a hydraulic cylinder in the aforesaid embodiment. Of course, the oscillating means is not limited thereto. For example, a wire rope of a winch is connected to the outer tube 4*a* of the telescoping arm 4, and the telescoping arm 4 can be also oscillated by winding or rewinding the wire rope.

Preferably, at lease a pair of the telescoping arms are disposed in the width direction of the machine body. In this case, a counterweight can be lifted or suspended more stably.

While one embodiment of the present invention has been disclosed as described above, it is noted that the scope of protection of the present invention is not limited thereto. Equivalents which exhibit the operation and effect of the present invention are included in the scope of the present invention.

We claim:

1. A device for attaching and detaching a counterweight of a construction machine mounted on a support bed standing out from a rear portion of an upper rotating body, comprising:

a telescoping device whose lower end is pivotally connected in the vicinity of said support bed;

a restiform body hung down through a guide unit provided at an end of a movable portion of said telescoping device, said restiform body having one end connected to said rear portion of said upper rotating body and the other end connected detachably to the counterweight; and oscillating means for oscillating said telescoping device around said lower end as fulcrum, oscillation of said telescoping device displacing the telescoping device from a substantially vertical attitude to an inclined attitude, when said counterweight is detached, to thereby move the counterweight suspended from said restiform body to a position without interfere with said support bed when the counterweight is moved downward.

2. The device according to claim 1, wherein said telescoping device comprises at least a pair of telescoping devices in a width direction of a body of the construction machine.

3. The device according to claim 1, wherein said restiform body comprises a chain.

4. The device according to claim 3, wherein said guide unit comprises a rotatable sprocket engaged with said chain.

5. The device according to claim 1, wherein said oscillating means comprises a hydraulic cylinder.

6. The device according to claim 5, wherein a lower end of said hydraulic cylinder is arranged in the vicinity of a pivotal portion of said telescoping device, and a rod of said hydraulic cylinder is connected to said telescoping device.

7. The device according to claim 1, wherein said telescoping device and said oscillating means are remote-controlled.

8. The device according to claim 1, wherein the device is operated by an operating body provided outside a body of said upper rotating body and close to the rear portion of the upper rotating body.

9. A construction machine comprising:

a lower traveling body;

an upper rotating body mounted rotatably on said lower traveling body, said upper rotating body having a support bed standing out from a rear portion thereof; and a device for attaching and detaching a counterweight mounted on said support bed, said device comprising a telescoping device having a lower end pivotally supported in the vicinity of said support bed, a restiform body suspended through a guide portion provided on said telescoping device, and oscillating means for oscillating said telescoping device around said lower end as fulcrum, said oscillating means displacing said telescoping device from a substantially vertical attitude to an inclined attitude when the counterweight is detached.

* * * * *